US010336538B1

(12) United States Patent
VandenBerg

(10) Patent No.: US 10,336,538 B1
(45) Date of Patent: Jul. 2, 2019

(54) PORTABLE HYDRAULIC SIDE-LOADER SYSTEM

(71) Applicant: Ken VandenBerg, North Haledon, NJ (US)

(72) Inventor: Ken VandenBerg, North Haledon, NJ (US)

( * ) Notice: Subject to any disclaimer, the term of this patent is extended or adjusted under 35 U.S.C. 154(b) by 155 days.

(21) Appl. No.: 15/713,869

(22) Filed: Sep. 25, 2017

(51) Int. Cl.
*B65F 1/12* (2006.01)
*B65F 1/14* (2006.01)

(52) U.S. Cl.
CPC ..... *B65F 1/1452* (2013.01); *B65F 1/12* (2013.01)

(58) Field of Classification Search
CPC ..... B65F 1/1452; B65F 1/12; B65F 1/122; B65F 3/02; B65F 3/0213; B65F 3/0223
USPC ..... 414/444, 457, 450
See application file for complete search history.

(56) References Cited

U.S. PATENT DOCUMENTS 2,650,786 A * 9/1953 Platt ..... B65F 1/1468 24/483
2,673,654 A * 3/1954 Kaufman ..... B62B 1/142 280/47.29
3,051,331 A * 8/1962 Schram ..... B65G 49/061 280/47.29
3,138,265 A * 6/1964 Hansen ..... B62B 3/108 414/428
3,275,175 A * 9/1966 Arnold ..... B62B 1/264 414/456
3,674,164 A * 7/1972 Kaufman ..... B62B 1/264 414/450
4,530,411 A * 7/1985 Grinwald ..... B62D 53/0864 180/11
5,582,500 A * 12/1996 Morris ..... B65F 1/1452 414/422
5,678,976 A * 10/1997 Rodriguez ..... B62B 1/264 414/448
6,309,167 B1 * 10/2001 Mc Pherrin ..... B60P 1/28 414/457
6,379,099 B1 * 4/2002 Novak ..... B65F 1/1452 414/404
6,644,907 B1 * 11/2003 Pinder ..... B65G 65/23 414/424
7,018,155 B1 * 3/2006 Heberling ..... B62B 3/0606 414/408
8,240,626 B2 * 8/2012 Kennedy ..... B65F 1/1468 220/23.4

(Continued)

FOREIGN PATENT DOCUMENTS

DE 10251516 B4 * 7/2006 ..... B30B 9/301
FR 2921053 A1 * 3/2009 ..... B65F 1/141

(Continued)

*Primary Examiner* — Kaitlin S Joerger
(74) *Attorney, Agent, or Firm* — Richard A. Joel

(57) ABSTRACT

The invention relates to a portable side-loader system which is built as a kit and can be retrofitted on to any container. The adjustable side loader may be detached from a fixed position and moved along the container as it fills up. The side-loader includes an integral bucket which may be activated to dump debris into the container. The side loader kit is a standalone system with its own hydraulics and 12 volt battery with an on board charging system. A control box holds the electrical components including the switches that activate and control the hydraulic system.

7 Claims, 5 Drawing Sheets

(56) References Cited

U.S. PATENT DOCUMENTS

| | | | | |
|---|---|---|---|---|
| 8,485,773 | B2 * | 7/2013 | Coats | B62B 1/06 280/47.3 |
| 8,684,653 | B2 * | 4/2014 | Applewhite | B65F 1/1452 414/404 |
| 9,028,192 | B2 * | 5/2015 | Wahls | B65F 1/1452 414/408 |
| 9,126,755 | B2 * | 9/2015 | Walter | B65F 1/1452 |
| 9,393,545 | B1 * | 7/2016 | Koh, II | B09B 3/00 |
| 2017/0275096 | A1 * | 9/2017 | Georgas | B65F 1/1452 |
| 2018/0111752 | A1 * | 4/2018 | Georgas | B65F 1/1452 |

FOREIGN PATENT DOCUMENTS

| | | | | |
|---|---|---|---|---|
| FR | 3002892 | A1 * | 9/2014 | B65F 1/1452 |
| GB | 2370826 | A * | 7/2002 | B65F 1/1452 |
| WO | WO-2011082445 | A1 * | 7/2011 | B65F 1/1452 |
| WO | WO-2013186446 | A1 * | 12/2013 | B65G 65/23 |
| WO | WO-2016036836 | A1 * | 3/2016 | B65F 1/12 |

* cited by examiner

PORTABLE HYDRAULIC SIDE-LOADER SYSTEM

CROSS REFERENCE TO RELATED APPLICATIONS

Not Applicable.

STATEMENT REGARDING FEDERALLY SPONSORED RESEARCH OR DEVELOPMENT

Not Applicable

PARTIES TO A JOINT RESEARCH AGREEMENT

Not Applicable

DESCRIPTION

Field of the Invention

This invention relates to a portable hydraulic side loader lifting system that mounts to the side of container or dumpster and permits the operator to load debris from an integral basket into the dumpster. The side loader may be moved along the length of the container as it fills up.

BACKGROUND OF THE INVENTION

The invention involves a portable side-loader system which is built as a kit and can be retrofitted on to any container. The side loader is adjustable and may be attached to various sized containers. The side loader kit also does not use any of the hydraulics from a truck but is a standalone system with its own battery and charging system. A hand held control box holds the switches that activate the system.

The adjustable side loader is on caster wheels to make it portable for attachment to different portions of the container as it fills up. The side loader controls are operated to pick up an integral basket or hopper and dump it into the container and to function in a clamping/transport mode wherein the side loader may be detached, transported along the side of the container on caster wheels and clamped in place.

The prior art includes U.S. Pat. No. 6,793,451 to Newfell which discloses a garbage handling system using material containers each pivotally mounted to the respective supports for movement between a lower material receiving position and a partially inverted material discharge position. The patent shows a materials collection vehicle which communicates with the containers when in the discharge position to receive the discharged materials U.S. Pat. No. 5,501,567 to Lansdor discloses a complex refuse system and refuse side-loader and recycling container vehicle. Recycling materials may either be placed in the hopper which is then elevated and tilted to discharge into the open end of a recycling bin or to elevate roll-off cart vehicles into an upper loading position.

Other patents of interest include U.S. Pat. No. 4,219,298 to Stagier, U.S. Pat. No. 3,342,358 to French, and U.S. Pat. No. 3,516,562 to Knight. The prior art extends back to 1921 with U.S. Pat. No. 1,379,007 to Fernandez.

Most of the prior patents are directed to containers which are picked up and dumped into a truck or container by the mechanism included therein. In contrast, the present invention relates to a side-loader kit which may be removably attached to a dumpster and contains its own integral basket to pick up debris. The side-loader is portable and may be moved along the container as it is loaded.

SUMMARY OF INVENTION

This invention relates to a side-loading dumping apparatus for a container which may be sold as kit and is relatively inexpensive. It is also adjustable for different size containers and portable so it can be moved along the side of a container to fill up the entire length of a container.

The unit comprises a standalone system and does not use any hydraulics from a truck. The portability is achieved by the retractable caster wheels which make it possible to roll the unit down the side of a container and clamp it at specific different locations. The load basket is attached on each side to a main arm on the unit and a selector valve is actuated to lift the arm and then dump the basket into the container.

Accordingly, it is an object of this invention to provide a new and improved dumping apparatus for containers.

It is another object of this invention to provide a new and improved side loading dumping apparatus for containers which is portable and adjustable for different size containers.

A more specific object of this invention is to provide a new and improved side-loader which is built as a kit and can be retrofitted on to any dumpster and includes a standalone hydraulic system and retractable caster wheels to make it portable.

BRIEF DESCRIPTION OF DRAWINGS

The above and other objects of this invention may be more clearly seen when viewed in conjunction with the accompanying drawings wherein.

DETAILED DESCRIPTION OF THE INVENTION

Figure 1:
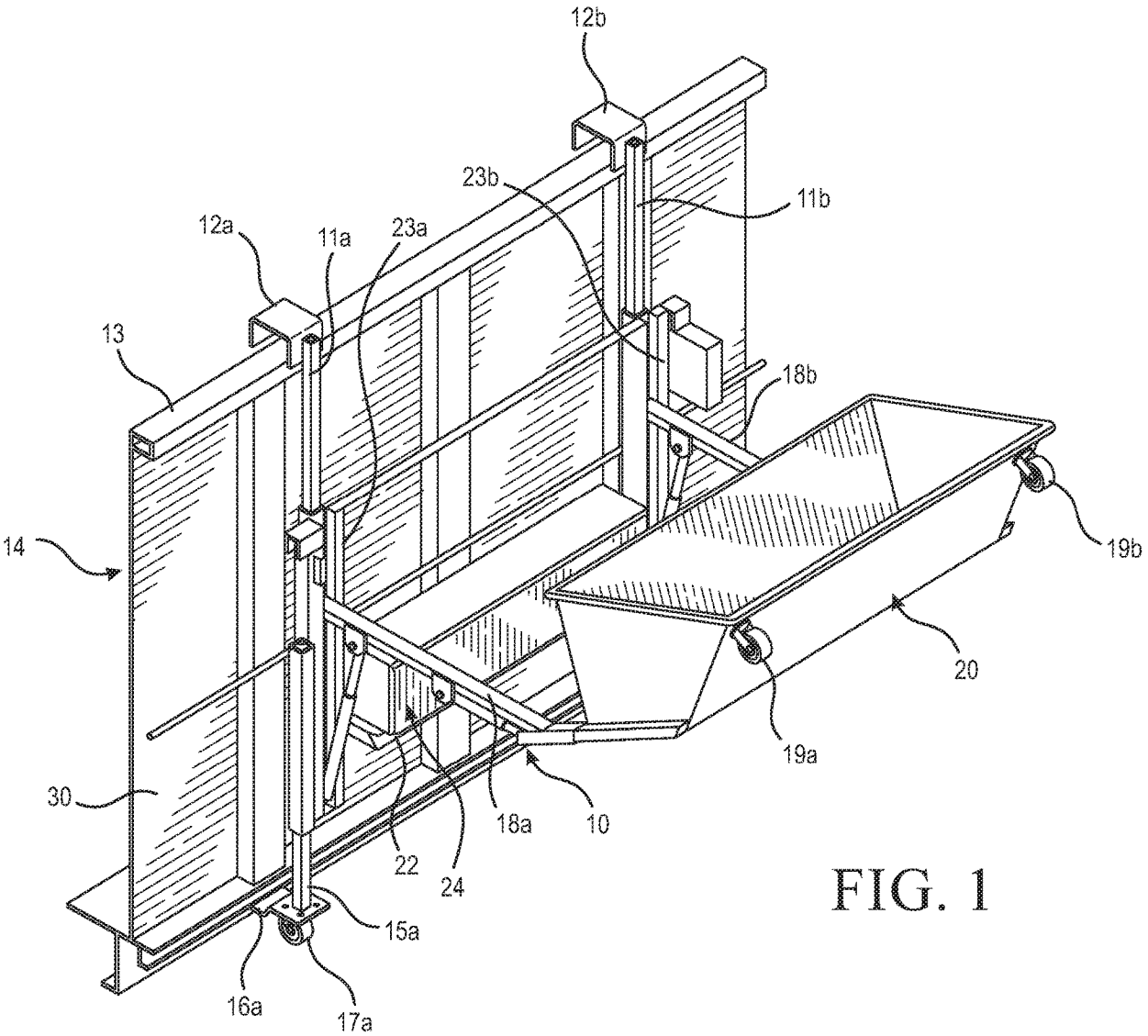
FIG. 1 is a perspective view of the side-loader invention connected to a portion of the side wall on a container.

Referring now to FIG. 1 of the drawings, the side-loader 10 comprises a pair of spaced vertical arms 11*a*, 11*b* with hooks 12*a*, 12*b* on the respective upper portions thereof to connect to the upper wall 13 of a container 14. The vertical arms 11*a*, 11*b* also include a pair of feet 15*a*, 15*b* having projections 16*a*, 16*b* thereon and casters 17*a*, 17*b* to permit movement of the side-loader 10 along the container or dumpster 14. Elements 16*b* and 17*b* are obscured by the bucket 20 in FIG. 1. The side-loader 10 is provided as a kit which may be used with containers 14 of various sizes. Only a portion of the side wall 30 of the container 14 is shown in FIG. 1. The arms 11*a*, 11*b* are vertically moveable to connect and lock to various sized vertical walls 30 on containers 14.

The casters 17*a*, 17*b* on the bottom feet 15*a*, 15*b* permit the side-loader 10 to be readily moved along the container 14 for loading purposes.

A pair of spaced main arms 18*a*, 18*b* extend outwardly from the side-loader 10 and connect to a pivotal bucket 20 at the exterior end thereof. The bucket 20 also includes casters 19*a*, 19*b* so that it is moveable along the ground.

Figure 2:
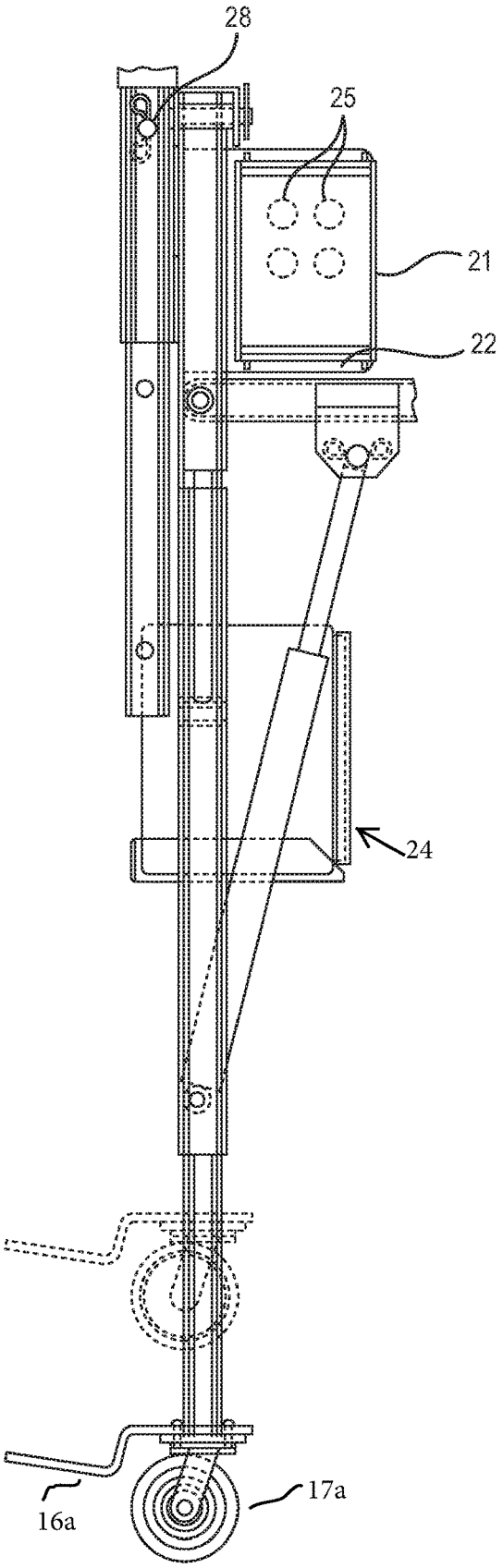
FIG. 2 is a partial side-view of the invention showing the control box and the adjustable caster wheels shown in operation in phantom.
Figure 3:
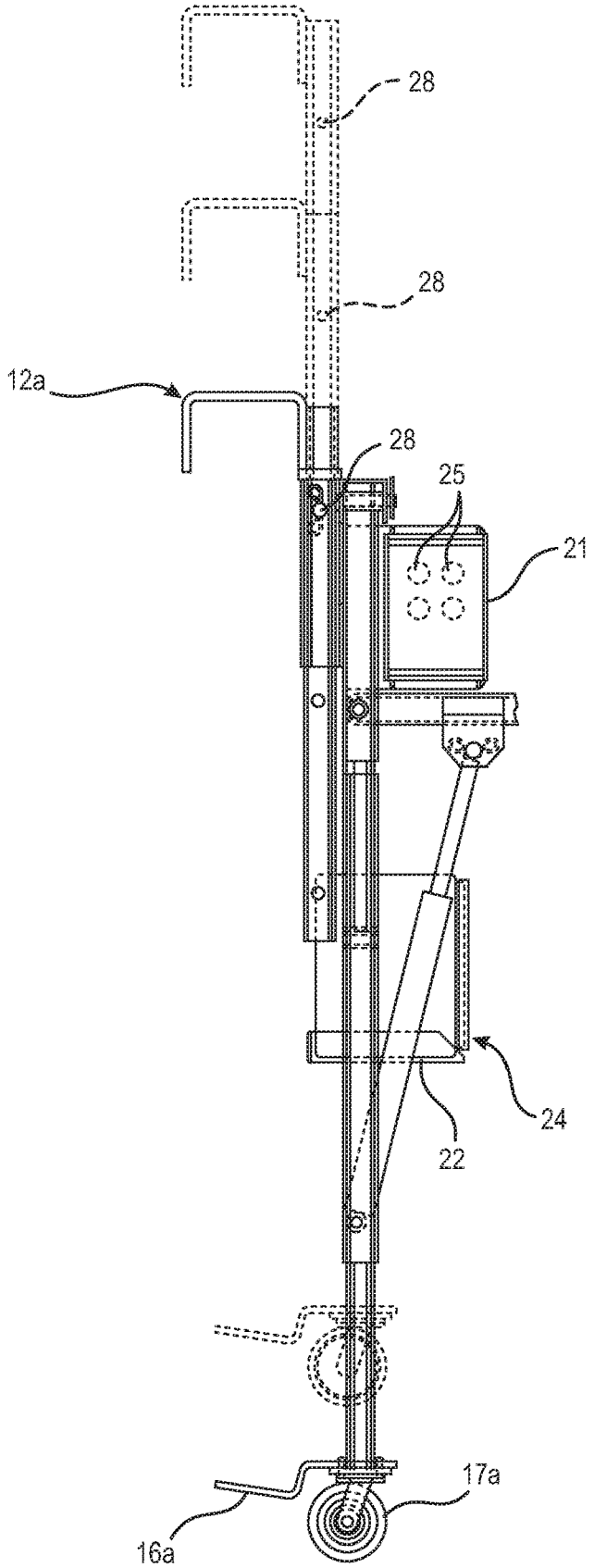
FIG. 3 is a partial side view of the invention showing in phantom the operation of the upper hook as well as the side-loader foot.

As shown in FIGS. 2 and 3, the power distribution box 24 is located on a shelf 22. The box 24 contains a 12 volt battery 50, an automatic smart battery charger and a DC powered hydraulic unit 41 with motor 42 and pump 43. The box enclosure protects against water, dust, or any other debris.

The side-loader controls 24 are positioned on a shelf and include four control box buttons 25 connected to a hydraulic selector valve 26 which operates the six side-loader functions. The functions are foot extend/retract, main-arm up/down and bucket curl/uncurl. The selector valve 26 will toggle one set of buttons 25 up/down between two modes of operation. The pair will be called a dual function set.

To be more specific, the side loader control system consists of five inputs, four buttons 25 and one selector lever 26. The four buttons 25 are grouped into two pairs. One pair "UP and DOWN" and the second pair, "IN and OUT". Each pair controls the extension and retraction of a set of hydraulic cylinders 35 or 36.

The selector valve 26 is used to toggle the use of the UP and DOWN button pair between the main arm cylinders 35 and the leg cylinders 36. This acts as a safety feature, locking out the use of the feet 16*a*, 16*b* while the main arms 11*a*, 11*b* are being used, preventing the operator from accidentally releasing the side loader 10 from the container 14 during operation.

With the selector vale 26 positioned to direct the flow to the leg cylinders 36, the operator can position the legs 11*a*, 11*b* to clamp the side loader 10 to a container 14 or position them so the side loader 10 can be moved on its casters 17*a*, 17*b*.

With the selector valve 26 positioned to direct flow to the main arm cylinders 35, the operator can control the position of the main arms 18*a*, 18*b* in conjunction with the bucket curl to dump debris from the hopper 20 to the container 14.

The button pair, IN and OUT, control the position of the hopper curl cylinders 38. The position of the hopper 20 can be used in conjunction with the main arms by the operator to dump debris from the hopper 20 into the container 14. The hopper position may also be used in conjunction with the leg position to set the side loader 10 into position to be moved on its casters 11*a*, 11*b*.

In the clamping/transport mode, the dual function set of buttons 25 will direct hydraulic control to the double acting hydraulic cylinders 36 that control the extension/retraction of the feet 15*a*, 15*b*. When extended, the side-loader 10 can be transported on the casters 17*a*, 17*b* to a new dumpster position and clamped.

In the operation mode, the dual function set of buttons 25 will direct hydraulic control to the double acting cylinders 35 that control the movement of the main arms 18*a*, 18*b*. Movement of the feet 15*a*, 15*b* is locked out, preventing the feet 15*a*, 15*b* from accidentally being operated.

The side-loader feet 15*a*, 15*b* are actuated by dual acting hydraulic cylinder 36 and serve two purposes. When the arms 11*a*, 11*b* are extended, the casters 17*a*, 17*b* are used for transport along the side of the container 14. When retracted, they will, as shown in FIG. 3, enable the side-loader 10 to clamp to any sized dumpster 14. The upper U-shaped hooks 12*a*, 12*b* are adjusted to different sized dumpsters 14 by removing a pin 28 from the frame aperture 29 and sliding until desired apertures are aligned and then reinserting the pin 28.

Figure 4:
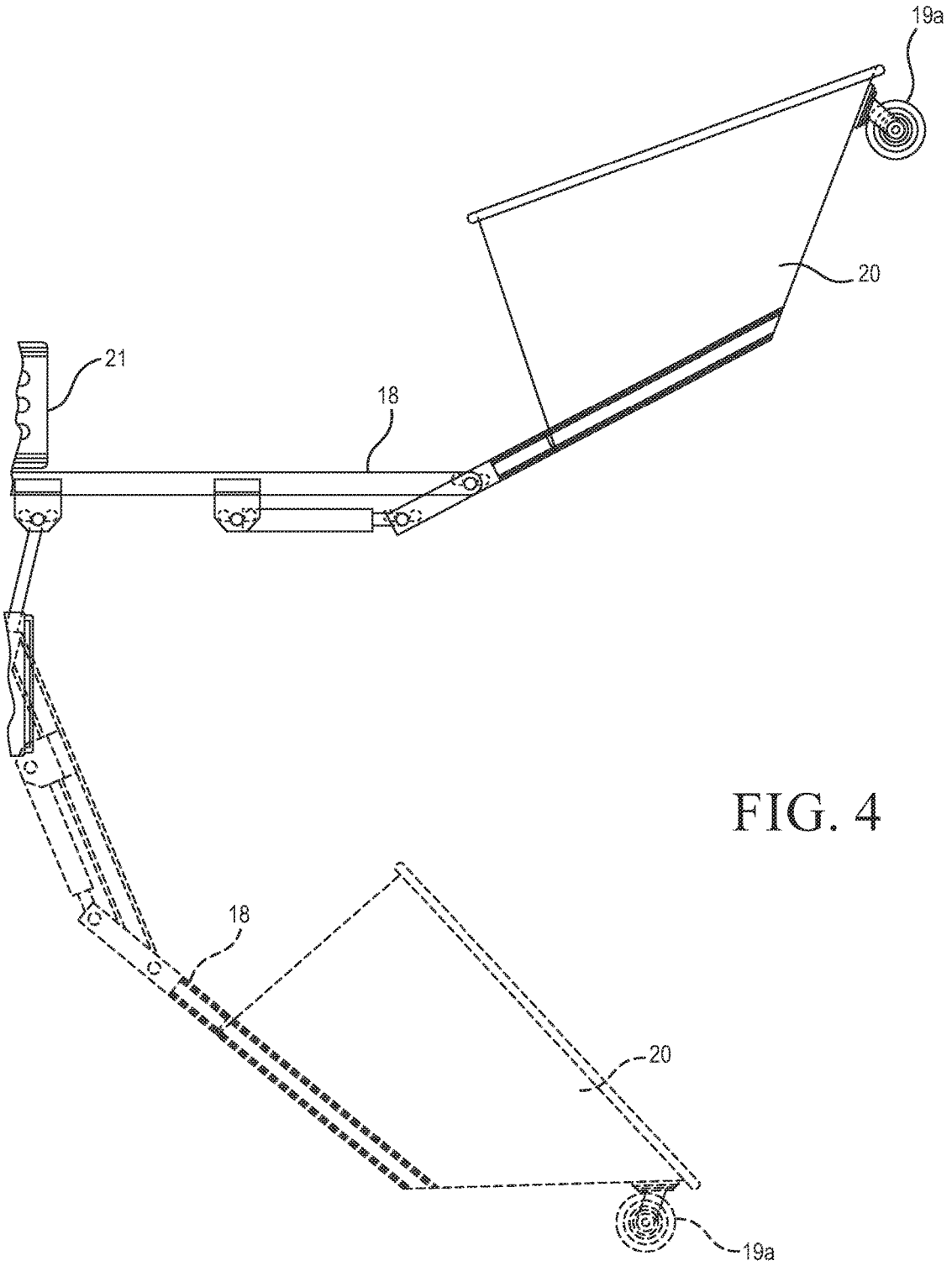
FIG. 4 is a partial side view of the bucket cantilever showing in phantom the operation thereof for dumping purposes.

As shown in FIG. 4, the bucket cantilever operates independently of the main arms 18*a*, 18*b* and serves three functions. First, when the main arm 18 is in the up position, it will facilitate positioning the dumping of the contents into the dumpster 14 while keeping the hydraulics clear of the dumpster 14. Next, while in the lower position, the hopper 20 is to be filled, the curl can be adjusted to set the desired height and angle. In the transport positioning, the bucket 20 and main arm should be fully down and the bucket 20 fully extended allowing the side-loader 10 to be supported the bucket 20 and casters 19*a*, 19*b*.

Figure 5:
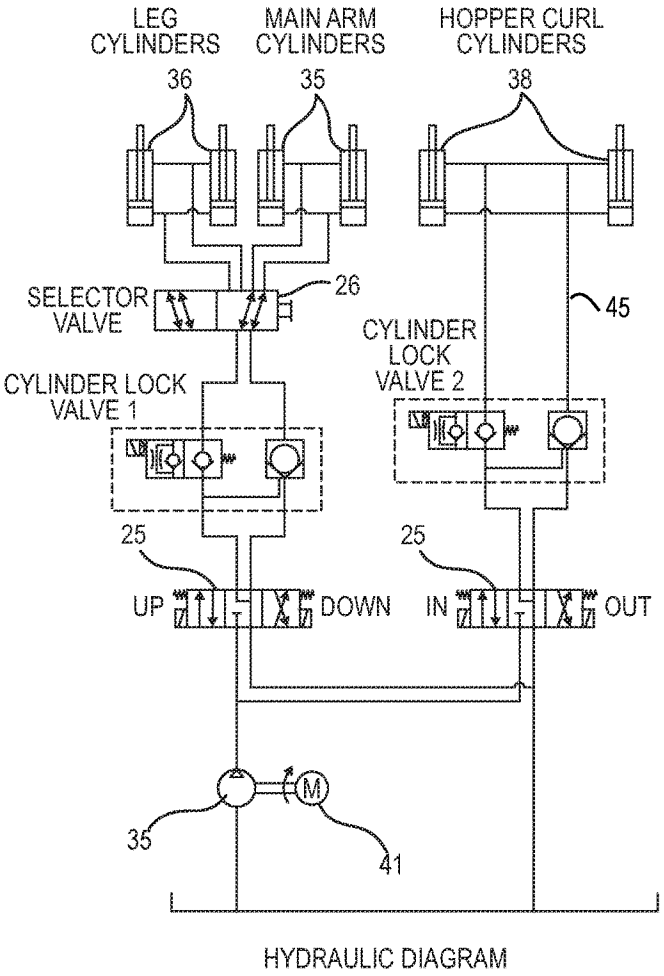
FIG. 5 is a schematic showing the hydraulic pump arrangement for the various cylinders; and, FIG. 6 is an electric schematic for the side-loader invention.

FIG. 5 is a schematic of the hydraulic system controlled by the selector valve 26 which is connected to the hydraulic pump unit 35 which supply hydraulic fluid to the system. As noted in the schematic, the selector valve 26 is connected to the two main arm cylinders 35 to raise or lower the arms. The selector valve 26 is also connected to the transport leg cylinders 37*a*, 37*b* to raise or lower the caster wheels depending on whether the side-loader 10 is to be moved or locked in place. Finally the selector valve 26 actuates a pair of hopper curl cylinders 38 which cause the hopper 20 to dump debris into the container 14. The hydraulic lines 45 are in various colors to readily show the connections.

Figure 6:
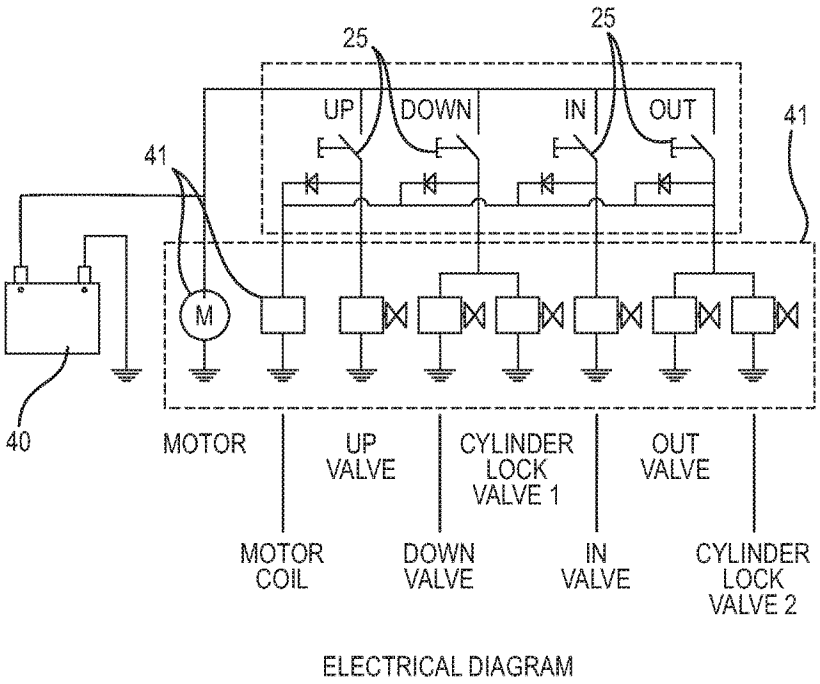

FIG. 6 is an electrical schematic which shows the 12 volt battery 40 which activates the system driving the motor 41 when the various control buttons 25 SB1 (up); SB2 (down); SB3 (in); and SB4 (out) are pushed. The buttons 25 control the various valves shown in the schematic.

While the invention has been explained by a detailed description of certain specific embodiments, it is understood that various modifications and substitutions can be made in any of them within the scope of the appended claims, which are intended also to include equivalents of such embodiments.

What is claimed is:

1. A side-loader for loading debris into an open container having a base and a plurality of walls extending upwardly from the base, one of said walls being a side wall, an upper lip along said wall and a bottom surface along the base of said wall thereof comprises:

a pair of spaced vertical arms having hooks at the upper ends thereof to engage the upper lip of the container side wall and retractable feet at the lower ends of the arms having a shelf to engage the bottom surface of the container base and having caster wheels at the end thereof;

a pivotal bucket to receive debris having a base and upwardly extending walls and having a pair of caster wheels mounted on the outer wall thereof to permit movement along the ground;

a pair of spaced arms mounted to the side walls of the bucket; and means to activate the arms to move the bucket upwardly and pivot the bucket over the container to drop debris from the bucket in the container.

2. A side-loader in accordance with claim 1, wherein:

the hooks are U shaped and coupled to a moveable portion of the vertical arms having spaced holes; and a pin engaging a hole at a height appropriate for the container to lock the arm in position on the upper lip of the container side wall.

3. A side-loader in accordance with claim 1, wherein:

the retractable feet are each coupled to a cylinder which raises or lowers the caster wheels to permit movement of the side-loader along the container.

4. A side-loader in accordance with claim 1, wherein the side loader further includes:

a control box mounted to a vertical arm having four control box buttons; and, a hydraulic selector valve operated by said buttons to control the side-loader functions.

5. A side-loader in accordance with claim 4 wherein:

the vertical arms each further include a retractable lower portion having a shelf to engage the base of the container to lock the side-loader to the container and said lower portion being actuated by the control buttons to disengage the shelf for purposes of portability.

6. A side-loader for loading debris into a container having a base and upwardly extending side walls having upper and lower portions comprises:

an integral kit having means for removably coupling said kit to upper and lower portions of a side wall container;

a bucket extending outwardly from the kit to receive debris; and hydraulic means to couple and uncouple the kit from the container and to operate the bucket for dumping.

7. A portable side-loader for loading debris into a container comprising:

means for locking the side-loader having upper and lower portions onto a container, said means comprising adjustable hooks on the upper portion thereof and adjustable lower shelf means on the lower portion thereof to engage the container;

a bucket extending outwardly from the side-loader to receive debris and means to actuate said bucket to dump debris in the container;

means to activate the lower shelf; and, means to engage and disengage from the container to permit the side-loader to be moved along the container.

* * * * *